United States Patent [19]

Nelsón

[11] Patent Number: 5,055,253

[45] Date of Patent: Oct. 8, 1991

[54] METALLIC COMPOSITION

[75] Inventor: Jerry L. Nelson, Mt. Clemens, Mich.

[73] Assignee: Nelson & Associates Research, Inc., Mt. Clemens, Mich.

[21] Appl. No.: 553,797

[22] Filed: Jul. 17, 1990

[51] Int. Cl.[5] ..... C22C 38/42

[52] U.S. Cl. ..... 420/87; 420/91; 420/112

[58] Field of Search ..... 420/87, 91, 112

[56] References Cited

U.S. PATENT DOCUMENTS

| | | | |
|---|---|---|---|
| 3,615,905 | 10/1971 | Omsen et al. | 148/12.4 |
| 3,660,174 | 5/1972 | Jakenberg | 148/12 |
| 3,834,951 | 9/1974 | Jakenberg | 148/36 |
| 3,867,135 | 2/1975 | Johnson et al. | 75/60 |
| 3,888,956 | 6/1975 | Klint | 264/5 |
| 3,898,079 | 8/1975 | Eriksson | 75/60 |
| 3,918,692 | 11/1975 | Oberg | 266/35 |
| 3,942,978 | 3/1976 | Oberg et al. | 75/51 |
| 4,046,598 | 9/1977 | Janzon | 148/12 R |
| 4,115,111 | 9/1978 | Itoh et al. | 420/112 |
| 4,236,096 | 11/1980 | Tiemann | 313/1 |
| 4,236,920 | 12/1980 | Lampe et al. | 75/128 A |
| 4,276,085 | 6/1981 | Wisell | 75/126 C |
| 4,428,781 | 1/1984 | Norstrom | 148/36 |
| 4,673,433 | 6/1987 | Roberts | 75/53 |
| 4,765,849 | 8/1988 | Roberts | 148/335 |
| 4,863,515 | 9/1989 | Roberts et al. | 75/238 |

FOREIGN PATENT DOCUMENTS

| | | | |
|---|---|---|---|
| 432224 | 11/1974 | U.S.S.R. | 420/91 |
| 592866 | 2/1978 | U.S.S.R. | 420/91 |

OTHER PUBLICATIONS

R. A. Grange et al., "Effect Of Copper On The Heat Treating Characteristics Of Medium-Carbon Steel", Transactions of the ASM, vol. 51, pp. 377-393.

M. R. Krishnadev et al., "Copper-Boron Low Alloy High Strength Steels", undated.

"The Making, Shaping And Treating Of Steel", Ed. Harold E. McGannon, United States Steel, 9th Edition, copyright 1971, Chapters 39, 42, 43, 44, 46, 47, 48 and 51.

"Guide To Tooling Materials", Penton Publishing, Inc., copyright 1987.

"Heat Treater's Guide", American Society For Metals, copyright 1982, pp. 450-451.

"Tool Steels", 4th Edition, American Society For Metals, copyright 1980, pp. 227-250.

*Primary Examiner*—Deborah Yee

*Attorney, Agent, or Firm*—Renner, Otto, Boisselle & Sklar

[57] ABSTRACT

The invention provides a novel metallic composition and method of using the same. More particularly, the invention affords a tool steel and a method of using the tool steel. In one of the preferred embodiments the tool steel includes about 0.50 to about 0.65 percent by weight carbon, about 0.090 to about 1.45 percent by weight manganese, up to about 0.030 percent by weight phosphorus, about 0.035 to about 0.070 percent by weight sulfur, about 1.10 to about 1.90 percent by weight chromium, about 0.15 to about 0.40 percent by weight nickel, about 0.20 to about 0.40 percent by weight copper and balance percent by weight iron and impurities.

11 Claims, 1 Drawing Sheet

METALLIC COMPOSITION

DISCLOSURE

The present invention concerns a metallic composition and a method of using the same. More particularly, the invention concerns a tool steel and a method of using the tool steel to produce dies or similar items.

BACKGROUND

The prior art provides various tool steels for use in producing items such as tools and dies. Such tool steels are generally classified as: (i) relatively low-alloy tool steels having higher hardenability than plain carbon steels; (ii) intermediate alloy steels which usually contain elements such as tungsten, molybdenum or vanadium, which form hard, wear resisting carbides; and (iii) high speed tool steels containing large amounts of carbide forming elements which serve not only to furnish wear resisting carbides but also to promote secondary hardening and thereby increase resistance to softening at elevated temperatures.

The relatively low-alloy and intermediate tool steels are commonly employed to produce dies which are utilized to shape, form, bend, draw, cut or otherwise process low carbon steels, stainless steels, and aluminum. Such materials prior to processing may assume any one of a variety of configurations such as, for example, bars, rods, strips or sheets. The automotive industry, which does a considerable amount of metal processing, utilizes various low-alloy and intermediate alloy tool steels to produce dies. Such dies are commonly employed in presses and are used to produce items such as, for example, hoods, fenders, roof decks and trunk lids. The automotive industry places some fairly critical demands upon the tool steels from which their dies are produced. More particularly, many automotive dies undergo a considerable amount of machining and grinding in order to allow the die to produce items of intricate shape and exacting size tolerances. Also, automotive dies are many times used to process a tremendous number of items and are thus subject to very long runs. Additionally, some automotive dies are very large in size and require a considerable amount of tool steel in their production. Thus, preferably the tool steel does not include major amounts of expensive alloying elements because the cost of the tool steel itself can be a significant factor in the construction of the dies.

An example of one tool steel utilized by the automotive industry to produce dies is a tool steel sold by the Uddeholm Corporation of Sterling Heights, Mich., under the trademark FERMO. Generally, FERMO tool steel would be classified as a relatively low-alloy tool steel having about 0.45 to 0.52 percent by weight carbon, 0.75 to 1.05 percent by weight manganese, 0.40 to 0.80 percent by weight silicon, and 1.30 to 1.70 percent by weight chromium. FERMO tool steel is preferred by some automotive personnel because it tends not to distort during flame hardening. Also, FERMO tool steel may be welded cold thereby facilitating repair of the die while it is mounted in the press or similar machine. Thus, such dies do not have to be removed from the press thereby helping to minimize costly downtime. Unfortunately, FERMO tool steels generally display a maximum Rockwell (R) hardness on the C-scale (Rc) of about 54 to 58. Thus, FERMO tool steel is generally not suited for long runs where a die is scheduled to be utilized to produce a great number of items or pieces.

An example of another tool steel utilized by the automotive industry includes about 0.85 to 1.0 percent by weight carbon, 0.20 to 0.30 percent manganese, 0.20 to 0.30 percent by weight silicon and 0.15 to 0.25 percent by weight vanadium. This tool steel is preferred by some automotive personnel because it can be repair welded in the press. However, flame hardening of this tool steel is conducted at a temperature of about 1600° F. to 1650° F. followed by a water quench. Unfortunately, distortion has been found many times to develop during this hardening treatment.

An example of another tool steel utilized by the automotive industry includes about 0.85 to 1.10 percent by weight carbon, 0.50 to 0.70 percent by weight manganese, 0.25 to 0.40 percent by weight silicon, 4.75 to 5.25 percent by weight chromium, 0.20 to 0.40 percent by weight vanadium and 0.95 to 1.20 percent by weight molybdenum. This tool steel is commonly flame hardened at a temperature of about 1800° F. or higher and generally displays a Rockwell hardness on the C-scale of around 60. This tool steel usually cannot be repair welded while the die is in the press. Generally, the damaged die, or sections thereof, must be removed from the press and preheated prior to repair welding. This can be a time consuming process leading to costly downtime.

Another tool steel utilized in the automotive industry includes about 0.45 to 0.55 percent by weight carbon, 1.0 to 1.20 percent by weight manganese, 0.30 to 0.50 percent by weight silicon, 1.00 to 1.25 percent by weight chromium and 0.35 to 0.45 percent by weight molybdenum. This alloy is generally supplied in an annealed condition having a Brinell hardness (BHN) number of about 180 to 220. Flame hardening of this tool steel is generally conducted at a temperature of about 1780° F. followed by a water quench to produce a Rockwell hardness on the C-scale of about 58 to 60. Problems experienced by some automotive personnel with this tool steel include distortion during flame hardening and a relatively low wear resistance.

Generally, the aforementioned steels are formed into dies while the tool steel is in an annealed and/or normalized condition. In order to attain this condition, such tool steels are generally annealed and/or subjected to a normalization treatment until the desired hardness is attained.

Relatively low alloy tool steels are also used in some applications to produce tools such as chisels. An example of a tool steel that was at one time utilized to produce chisels contained about 0.35 percent by weight carbon, 0.70 percent by weight manganese, 0.45 percent by weight silicon, 0.80 percent by weight chromium, 0.30 percent by weight molybdenum and 0.30 percent by weight copper. This tool steel was preferred for such applications as chisels because of its tendency not to become brittle and break during use. This tool steel generally would not be used to produce dies because of its inability to consistently produce Rockwell hardnesses on the C-scale in excess of about 54.

SUMMARY OF INVENTION

The present invention provides a novel metallic composition. More particularly, the present invention provides a novel relatively low-alloy tool steel for use in producing tools, dies and other similar items. The tool steel is particularly well suited for use in producing dies for the automotive industry.

The tool steel affords various distinct advantages over many prior art tool steels. Specifically, the tool steel of the present invention may be flame hardened by a user with virtually no distortion. This allows an end user to finish machine and grind the die in a soft (i.e., pre-hardened) condition and flame harden the die while it is mounted in the press just prior to final die try out or just prior to production. Similarly, the tool steel allows the die to be repair welded while the die is mounted in the press or machine. Also, the tool steel allows the die to be finished while the tool steel is in a pre-hardened fully machinable condition having a Rockwell hardness on the C-scale of about 38 to about 40. The tool steel also provides case hardening depths of about three-sixteenths of an inch to about three-eighths of an inch during flame hardening thereby helping to ensure long runs for dies produced utilizing the tool steel. Furthermore, since the tool steel does not contain major amounts of expensive alloying elements, it is a relatively inexpensive material for use in the production of dies and similar items.

The tool steel includes up to about 0.95 percent by weight carbon, about 0.075 to about 1.60 percent by weight manganese, about 0.020 to about 0.090 percent by weight sulfur, about 1.0 to about 2.0 percent by weight chromium, about 0.10 to about 0.50 percent by weight nickel and the balance percent by weight iron and impurities. Preferably, the tool steel also includes at least about 0.20 percent by weight copper. In another preferred embodiment the tool steel comprises about 0.50 to about 0.65 percent by weight carbon, about 0.090 to about 1.45 percent by weight manganese, up to about 0.030 percent by weight phosphorus, about 0.035 to about 0.070 percent by weight sulfur, about 1.10 to about 1.90 percent by weight chromium, about 0.15 to about 0.40 percent by weight nickel, about 0.20 to about 0.40 percent by weight copper and the balance percent by weight iron and impurities.

Prior to converting the tool steel into a die, and subsequent to casting the tool steel, it is preferably subjected to a heat treatment schedule. During the heat treatment schedule the tool steel is initially normalized, then austenitized, and finally double tempered. During normalization, preferably the tool steel is heated to an equalization temperature of about 1300° F. and soaked for about two hours. The tool steel is then air cooled to room temperature. During austenization the tool steel is preferably heated to an equalization temperature of about 1580° F., and then quenched in oil held at a temperature of about 150° F. During each of the tempers the tool steel is preferably heated to an equalization temperature of about 1000° F. to about 1100° F. and held at temperature for about one hour followed by air cooling to room temperature.

The above heat treatment schedule produces a Rockwell hardness on the C-scale of about 38 to about 40. In this condition, the tool steel may be easily worked into a tool, die or other item. Subsequent to working, the tool steel may then be flame hardened at a temperature of about 1560° F. to produce a Rockwell hardness on the C-scale of between about 60 and 62 and a case depth of about three-sixteenths of an inch to about three-eighths of an inch.

The foregoing and other features of the invention are hereinafter more fully described and particularly pointed out in the claims, the following detailed description and the annexed drawings setting forth in detail certain illustrative embodiments of the invention, these being indicative, however, of but a few of the various ways in which the principles of the present invention may be employed.

DETAILED DESCRIPTION

The present invention provides a relatively low-alloy tool steel suitable for use in producing any one of a variety of items such as, for example, tools, dies, knives, punches and molds. However, the tool steel is particularly well suited for use in producing dies. The tool steel is particularly well suited to dies subject to demanding applications such as the dies employed by the automotive industry.

Figure 1:
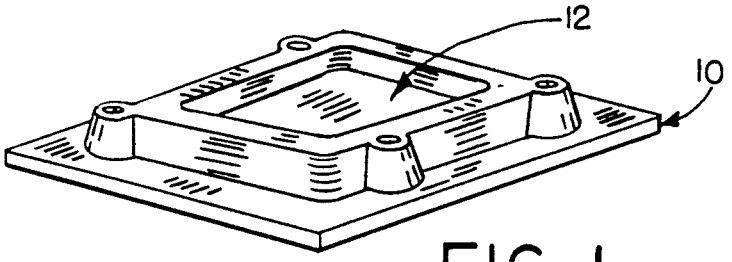
FIG. 1 is a perspective view of a die made in accordance with the principles of the present invention.
Figure 2:
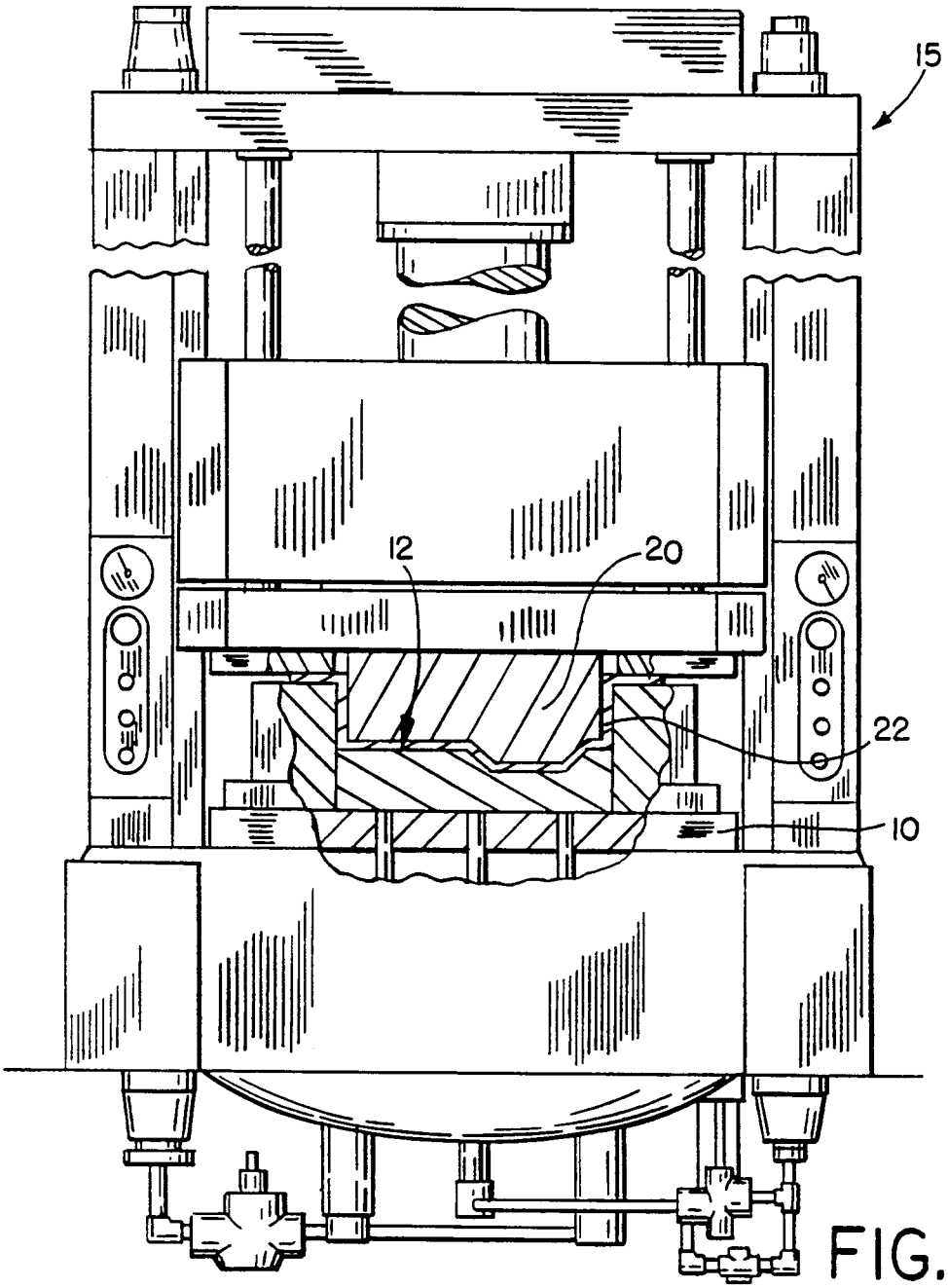
FIG. 2 is a schematic partial cross-section of the die of FIG. 1 mounted in a press.

Shown in FIG. 1 is a die 10 produced utilizing applicant's tool steel. For the purposes of this specification, and the claims below, a die is defined as a tool that imparts shape to solid, molten or powdered metal because of the shape of the tool itself. Such dies are used in various press operations including blanking, drawing, forming, in die casting and in forming green powder and metallurgy compacts. Die 10 is preferably machined or ground to its final shape while the die 10 is in a pre-hardened or soft condition. Once the die 10 has been worked to its final configuration, the working surface 12 of the die 10 is then flame hardened. Illustrated in FIG. 2 is a press 15 in which die 10 is mounted. As a result of the application of pressure imparted by the press 15 upon the die 10 and the punch 20, a workpiece 22 is formed into a finished or semi-finished part.

As is well-known in the art, tool steels are metallic compositions that predominately contain iron and are alloyed with various other elements such as, for example, carbon, manganese, chromium, nickel, and molybdenum. Tool steels are generally characterized by high hardness and resistance to abrasion.

The tool steel of the present invention is produced utilizing conventional melting practices to provide a tool steel having up to about 0.95 percent by weight carbon, about 0.075 to about 1.60 percent by weight manganese, about 0.020 to about 0.090 percent by weight sulfur, about 1.0 to about 2.0 percent by weight chromium, about 0.10 to about 0.50 percent by weight nickel and balance percent by weight iron and impurities.

Preferably, the tool steel includes copper and is killed or deoxidized utilizing primarily silicon. Also, preferably the amount of phosphorus contained in the tool steel is limited. In another preferred embodiment the tool steel includes about 0.4 to about 0.8 percent by weight carbon, about 0.090 to about 1.45 percent by weight manganese, up to about 0.050 percent by weight phosphorus, about 0.030 to about 0.080 percent by weight sulfur, at least about 0.20 percent by weight silicon, about 1.10 to about 1.90 percent by weight chromium, about 0.15 to about 0.40 percent by weight nickel, at least about 0.20 percent by weight copper and balance percent by weight iron and impurities.

More preferably, the tool steel comprises about 0.50 to about 0.65 percent by weight carbon, about 0.090 to about 1.45 percent by weight manganese, up to about 0.050 percent by weight phosphorus, about 0.030 to about 0.080 percent by weight sulfur, about 0.30 to about 1.0 percent by weight silicon, about 1.10 to about 1.90 percent by weight chromium, about 0.15 to about 0.40 percent by weight nickel, about 0.20 to about 0.40 percent by weight copper and balance percent by weight iron and impurities.

In a further preferred embodiment of the invention the tool steel comprises about 0.55 to about 0.60 percent by weight carbon, about 1.05 to about 1.25 percent by weight manganese, up to about 0.030 percent by weight phosphorus, about 0.035 to about 0.070 percent by weight sulfur, about 0.50 to about 0.80 percent by weight silicon, about 1.3 to about 1.70 percent by weight chromium, about 0.20 to about 0.30 percent by weight nickel, about 0.25 to about 0.35 percent by weight copper, and balance percent by weight iron and impurities.

Preferably, like phosphorus, other residual elements contained in the tool steel are controlled such that iron accounts for about 90.0 percent by weight of the tool steel. More preferably, iron accounts for about 92.0 percent by weight of the tool steel. More particularly, preferably the amount of residual molybdenum contained in the steel is limited to about 0.30 percent by weight, and more preferably it is limited to about 0.20 percent by weight of the tool steel. Likewise, preferably the vanadium contained in the tool steel is limited to about 0.020 percent by weight, and more preferably, it is limited to about 0.010 percent by weight of the tool steel. The presence of excess amounts of vanadium, molybdenum and other hardening agents may cause excessive undesirable hardening characteristics in the tool steel.

The tool steel is preferably cast at a temperature between about 2825° F. and about 2860° F. Preferably, the molds in which the tool steel is cast are stripped at about 600° F. and the tool steel is then allowed to air cool. Anyone of a variety of steel melting techniques and/or processes may be utilized to produce the tool steel. For example, an electric furnace, basic oxygen furnace or an induction furnace may be utilized to produce the molten tool steel. Likewise, anyone of a variety of casting techniques may be employed such as top pour molds, bottom pour molds, sand molds, metal molds or a continuous caster may even be employed. Further, the tool steel may be cast into anyone of a variety of shapes such as, for example, blooms, billets, ingots, bars or into the pattern of a die. Preferably, the tool steel is cast to its near final desired shape. However, if necessary, subsequent to stripping the tool steel may be heated to a suitable temperature and hot-worked into alternative shapes.

Subsequent to stripping and cooling, the tool steel is then preferably subjected to a heat treatment schedule. The heat treatment schedule softens the tool steel thereby facilitating the cutting, machining, or other operations that may be utilized to convert the as cast tool steel into a die or similar item. This heat treatment schedule refines the grain structure of the as cast tool steel placing it in a pre-hardened condition suitable for machining, grinding and flame hardening with substantially no distortion.

The heat treatment schedule includes normalization, austenization, and a double temper. Normalization is performed by heating the tool steel to an equalization temperature of about 1300° F. where it is held at temperature for about one to about three hours for every inch of cross-section based upon the thickest or heaviest section of the tool steel, and preferably about two hours per inch of such cross-section, and then allowed to air cool to room temperature. As used herein this specification, and the claims below, the term "equalization" refers to a substantially equal, homogeneous, or uniform temperature throughout the piece or section of tool steel.

Austenization is performed at an equalization temperature of about 1540° F. to about 1600° F., and preferably about 1580° F. The tool steel is held at this equalization temperature for about thirty to ninety minutes per inch of cross-section based upon the thickest section of the tool steel, and preferably one hour for each inch of such cross-section, then quenched in oil having a temperature of about 125° F. to about 175° F., and preferably about 150° F. Each of the tempers is performed at an equalization temperature of about 1000° F. to about 1100° F. for a period of between about thirty and about ninety minutes per inch of cross-section based upon the thickest section of the tool steel, and preferably about one hour per inch of such cross-section. The tool steel is then air cooled to room temperature. Preferably, during each of the tempers the tool steel is charged into a furnace or oven which has been preheated to temperature.

Subsequent to heat treatment, the tool steel is in a pre-hardened condition and it generally displays a Rockwell hardness of about 38 to about 40 on the C-scale. In this pre-hardened condition, the tool steel is relatively easy to machine, grind or otherwise process into a die such as die 10 shown in FIG. 1. Since the tool steel is relatively soft, it is unlikely to chip or break during such processing. As used herein this specification, and the claims below, "Rockwell" on the "C-scale" refers to hardness values obtained using a standard sphero-conical diamond penetrator.

Once the tool steel has been fully processed and finished into a die 10, the die 10 may then be post-hardened in a furnace, oven or similar heating device. Preferably, the die 10 is flame hardened and air cooled along the working surface 12 in order to produce a Rockwell hardness on the C-scale of about 60 to about 62, with virtually no distortion. During flame hardening, case depths of between about three-sixteenths of an inch to about three-eighths of an inch may be attained on the working surface 12. Preferably, flame hardening is accomplished by heating the surface of the tool steel to a temperature of between about 1530° F. to about 1600° F., and preferably about 1560° F., followed by air cooling. This flame hardening step may be carried out while the die 10 is mounted in the press 15. Similarly, the die 10 may be repair welded in the press 15 without any preheating.

It will be appreciated that although the above description has been primarily focused upon dies, the tool steel of the present invention is also well suited for use in producing various other items such as punches, knives, blades and any other variety of items where the properties of a tool steel are desired.

In summary the invention provides a metallic composition comprising from about 0.50 to about 0.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 0.50 to about 0.80 percent by weight silicon (Si), from about 1.30 to about 1.70 percent by weight chromium (Cr), up to about 0.010 percent by weight vanadium (V), up to about 0.20 percent by weight molybdenum (Mo), from about 0.15 to about 0.40 percent by weight nickel (Ni), from about 0.20 to about 0.40 percent by weight copper (Cu) and the balance percent by weight, iron (Fe) and impurities.

Although the invention has been shown and described with respect to preferred embodiments, it is obvious that equivalent alterations and modifications will occur to others skilled in the art upon reading and understanding the specification. The present invention includes all such equivalent alterations and modifications, and is limited only by the scope of the following claims.

What is claimed is:

1. A metallic composition comprising from about 0.50 to about 0.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 0.50 to about 0.80 percent by weight silicon (Si), from about 1.30 to about 1.70 percent by weight chromium (Cr), up to about 0.010 percent by weight vanadium (V), up to about 0.20 percent by weight molybdenum (Mo), from about 0.15 to about 0.40 percent by weight nickel (Ni), from about 0.20 to about 0.40 percent by weight copper (Cu) and the balance percent by weight iron (Fe) and impurities.

2. A steel tool comprising from about 0.50 to about 0.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 0.50 to about 0.80 percent by weight silicon (Si), from about 1.30 to about 1.70 percent by weight chromium (Cr), up to about 0.010 percent by weight vanadium (V), up to about 0.20 percent by weight molybdenum (Mo), from about 0.15 to about 0.40 percent by weight nickel (Ni), from about 0.20 to about 0.40 percent by weight copper (Cu) and the balance percent by weight iron (Fe) and impurities.

3. A die for use in forming materials, said die including a tool steel comprising from about 0.50 to about 0.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 0.50 to about 0.80 percent by weight silicon (Si), from about 1.30 to about 1.70 percent by weight chromium (Cr), up to about 0.010 percent by weight vanadium (V), up to about 0.20 percent by weight molybdenum (Mo), from about 0.15 to about 0.40 percent by weight nickel (Ni), from about 0.20 to about 0.40 percent by weight copper (Cu) and the balance percent by weight iron (Fe) and impurities.

4. A metallic composition as set forth in claim 1 including from about 0.25 to about 0.35 percent by weight copper (Cu).

5. A metallic composition as set forth in claim 1 including from about 0.55 to about 0.60 percent by weight carbon.

6. A metallic composition as set forth in claim 1 wherein said manganese (Mn) is present in a range from about 1.05 to about 1.25 percent by weight.

7. A metallic composition as set forth in claim 1 wherein said sulfur (S) is present in a range from about 0.035 to about 0.070 percent by weight.

8. A metallic composition as set forth in claim 1 wherein said nickel (Ni) is present in a range from about 0.20 to about 0.30 percent by weight.

9. A metallic composition as set forth in claim 1 including at least about 90 percent by weight iron (Fe).

10. A metallic composition as set forth in claim 4 including at least about 92 percent by weight iron (Fe).

11. A die as set forth in claim 3 including a case depth of from about three-sixteenths of an inch to about three-eighths of an inch.

* * * * *